US006697597B2

(12) United States Patent
Senda

(10) Patent No.: US 6,697,597 B2
(45) Date of Patent: Feb. 24, 2004

(54) THERMAL FIXING DEVICE AND AN IMAGE FORMING DEVICE THAT RAPIDLY EXECUTES A FIXING OPERATION

(75) Inventor: Seiichi Senda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/252,949

(22) Filed: Sep. 24, 2002

(65) Prior Publication Data

US 2003/0059235 A1 Mar. 27, 2003

(30) Foreign Application Priority Data

Sep. 27, 2001 (JP) ..... P2001-298626

(51) Int. Cl.[7] ..... G03G 15/20
(52) U.S. Cl. ..... 399/330; 399/69
(58) Field of Search ..... 399/330, 328, 399/67, 69; 219/216

(56) References Cited

U.S. PATENT DOCUMENTS 6,301,454 B1 * 10/2001 Nishida et al. ..... 399/69

FOREIGN PATENT DOCUMENTS

| | | | |
|---|---|---|---|
| JP | A 8-44241 | | 2/1996 |
| JP | A 8-137325 | | 5/1996 |
| JP | 9-106212 A | * | 4/1997 |
| JP | A 10-91017 | | 4/1998 |
| JP | A 11-174901 | | 7/1999 |
| JP | A 2000-235325 | | 8/2000 |

* cited by examiner

*Primary Examiner*—Quana M. Grainger
(74) *Attorney, Agent, or Firm*—Oliff & Berridge, PLC

(57) ABSTRACT

A thermal fixing device and an image forming apparatus having a thermal fixing device being capable of executing a fixing operation rapidly for printing mediums of different sizes with a stable fixing temperature at any time without causing a hot offset is provided. In a first halogen lamp A and a second halogen lamp B, thermal density (A1) of a first heat region corresponding to a first region HX that a small size paper 3*a* contacts and thermal density (B1) of a first heat region BX, and thermal density (A2) of a second heat region AY corresponding to a second region HY that a large size paper 3*b* contacts and thermal density (B2) of a second heat region BY are set so as to satisfy conditions that A1>A2 and B1<B2, and A1+B1<A2+B2. The second region HY is positioned on two ends of the first region HX. In the fixing operation of a large size paper 3*b*, the first halogen lamp A is always on and the second halogen lamp B is controlled to be on/off.

24 Claims, 6 Drawing Sheets

THERMAL FIXING DEVICE AND AN IMAGE FORMING DEVICE THAT RAPIDLY EXECUTES A FIXING OPERATION

BACKGROUND OF THE INVENTION

1. Field of Invention

The invention is related to a thermal fixing device and an image forming apparatus having a thermal fixing device.

2. Description of Related Art

The device for forming an image by an electrophotographic method, such as a laser printer, has a thermal fixing device having a heat roller and a pressure roller for fixing toner transferred to a paper. Heat is applied to toner on a paper and the toner is fixed while the paper passes between the heat roller and the pressure roller.

The heat roller has a cylindrical shape and has a length corresponding to a whole width of a maximum size paper that can be used in a printer. A halogen lamp is arranged in the heat roller over a whole length in its axial direction. Almost the whole length of the heat roller in its axial direction is heated by heat generated from the halogen lamp. With this structure, the whole width of the maximum size paper can be heated.

In a normal printer, toner is fixed by one thermal fixing device for both a maximum size paper (for example, A4 size) and a minimum size paper (for example, B5 size) that can be used in a printer. In a thermal fixing device of the related art, the heat roller is always heated over a whole region in its axial direction. Therefore, when toner is fixed on a minimum size paper, the paper absorbs heat and the temperature is decreased in only a portion of the heat roller where the minimum size paper is contacted. However, temperature is not decreased at a portion of the heat roller where the paper is not contacted, i.e., the two ends of the heat roller.

On the other hand, because the temperature of a portion of the heat roller where a minimum size paper is contacted is controlled to be within a predetermined range (fixing temperature), the temperature of a portion of the heat roller where a minimum size paper is not contacted, that is the temperature of a surface of the two ends of the heat roller, becomes higher than the fixing temperature.

When toner is fixed on a maximum size paper after a fixing operation of a minimum size paper, the two end portions of the heat roller where the temperature is high are contacted to a maximum size paper. If the two ends portions of the heat roller are excessively heated, a hot offset is caused due to over-fixing of toner. The hot offset is caused when toner, that is melted too much, is adhered to a surface of the heat roller.

To prevent the above-described problem, after the fixing operation of a minimum size paper, the fixing operation is not executed until the surface temperature of a portion where the temperature is high becomes decreased to the fixing temperature. However, the efficiency of an image forming operation is extremely lowered.

SUMMARY OF THE INVENTION

In the invention, a fixing operation is executed rapidly with a stable fixing temperature at any time and without causing hot offset for printing mediums with different sizes.

In the thermal fixing device of the invention, a first region is provided in a heating element and a second region is continuously formed in the heating element. The heating element is heated by a first heat generating element and a second heat generating element.

A first heat region corresponding to the first region and a second heat region corresponding to the second region are provided in the first heat generating element. Thermal density A1 of the first heat region is higher than thermal density A2 of the second heat region. When the first heat generating element is turned on, a calorie generated by the first heat region is larger than a calorie generated by the second heat region.

A first heat region corresponding to the first region and a second heat region corresponding to the second region are provided in the second heat generating element. Thermal density B1 of the first heat region is lower than thermal density B2 of the second heat region. When the second heat generating element is turned on, a calorie generated by the first heat region is smaller than a calorie generated by the second heat region.

In a fixing operation of a small size printing medium, only the first heat generating element is turned on and the second heat generating element is off. The thermal density of the first heat region of the first heat generating element is higher than the thermal density of the second heat region and heat is not generated from the second heat generating element. Therefore, only the first region of the heating element is heated surely by the first heat generating element. Because a small size printing medium is transported while contacting the first region, the fixing operation of a small size printing medium can be executed precisely.

At this time, a small size printing medium does not contact the second region of the heating element, however, in the first heat generating element, the thermal density of second heat region is lower than the thermal density of the first heat region and heat is not generated from the second heat generating element. Therefore, in a fixing operation of a small size printing medium, the second region of the heating element is not heated excessively.

One heat generating element may have three or more heat regions. The heat element may be heated by three or more heat generating elements. In this case, the number of the heat generating element is N and there are provided a first heat generating element A, a second heat generating element B . . . a Nth heat generating element N. The first heat generating element has a first heat region, a second heat region . . . a nth heat region. Thermal density of each heat region is represented by A1, A2 . . . An. The second heat generating element has a first heat region, a second heat region . . . a nth heat region. Thermal density of each heat region is represented by B1, B2 . . . Bn. The Nth heat generating element has a first heat region, a second heat region . . . a nth heat region. Thermal density of each heat region is represented by N1, N2 . . . Nn.

The total (A1+B1 . . . +N1) thermal density of the first heat region of each heat generating element becomes smaller than the total (A2+B2 . . . +N2, A3+B3 . . . +N3 . . . An+Bn . . . +Nn) thermal density of each heat region other than the first heat region of each heat generating element. The thermal density of each heat region is determined so as to satisfy a relation of the following formula:

$$(A1+B1 \ldots +N1)<(A2+B2 \ldots +N2)$$

$$(A1+B1 \ldots +N1)<(A3+B3 \ldots +N3)$$

$$\cdot$$

$$\cdot$$

$$(A1+B1 \ldots +N1)<(An+Bn \ldots +Nn)$$

BRIEF DESCRIPTION OF THE DRAWINGS

Exemplary embodiments of the invention will be described in detail with reference to the following figures, wherein:

FIG. 4A is a timing chart of a thermal fixing operation of a large paper and FIG. 4B is a timing chart of a thermal fixing operation of a small paper;

FIG. 5A is a chart where a relation that $A1+B1<A2+B2$ is satisfied and FIG. 5B is a chart where a relation that $A1+B1 \geqq A2+B2$ is satisfied.

DETAILED DESCRIPTION OF PREFERRED EMBODIMENTS

Figure 1:
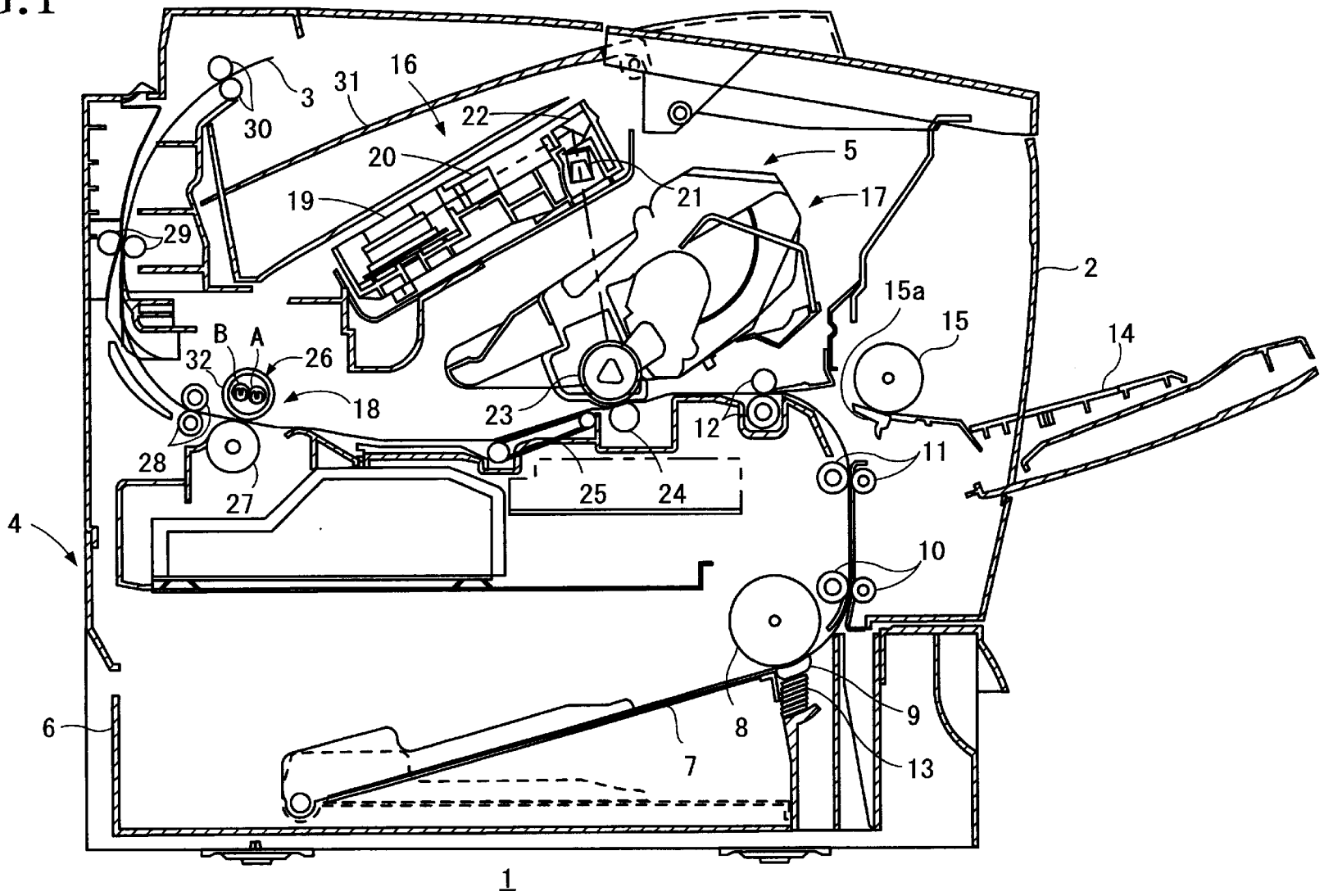
FIG. 1 is a side cross-sectional view of main portions of a laser printer.

As shown in FIG. 1, a feeder portion 4 for feeding a paper 3 and an image forming portion 5 for forming an image on the fed paper 3 are arranged in a casing 2 of a laser printer 1.

The feeder portion 4 is provided with a paper supply tray 6 arranged detachably to a bottom surface of the casing 2, a pressing plate 7 arranged in the paper supply tray 6, a paper supply roller 8 and a paper supply pad 9 arranged on an upper end of the paper supply tray 6, transporting rollers 10, 11 arranged in a lower stream side of a paper 3 feeding direction from the paper supply roller 8, and a resist roller 12 arranged in a lower stream side of the paper 3 feeding direction from the transporting rollers 10, 11.

Papers 3 can be stacked on the pressing plate 7. An end portion of the pressing plate 7 that is far from the paper supply roller 8 is supported so that an end portion of the pressing plate 7 that is close to the paper supply roller 8 is movable up and down. A spring (not shown) is arranged on a rear side of the pressing plate 7 and the pressing plate 7 is urged upward by the spring. The pressing plate 7 is swung downward against an urging force of the spring around the end portion that is far from the paper supply roller 8.

The paper supply roller 8 and the paper supply pad 9 are arranged so as to face each other. A spring 13 is arranged on a rear side of the paper supply pad 9 so as to press the paper supply pad 9 toward the paper supply roller 8.

A top of the paper 3 on the pressing plate 7 is pressed toward the paper supply roller 8 from the rear side of the pressing plate 7 by the spring. The top of the paper 3 is held between the paper supply roller 8 and the paper supply pad 9 by rotation of the paper supply roller 8 and a paper is separated one by one and fed. The fed paper 3 is transported to the resist roller 12 by the transporting rollers 10, 11. The resist roller 12 is comprised of a pair of rollers. The resist roller 12 corrects the slant of a paper 3 and feeds the paper 3 to the image forming portion 5.

The feeder portion 4 is further provided with a multipurpose tray 14 and a roller 15 and a pad 15*a* for supplying a paper 3 stacked on the multipurpose tray 14. The roller 15 and the pad 15*a* are arranged so as to face with each other. A spring is arranged on a rear side of the pad 15*a* and presses the pad 15*a* toward the roller 15. A plurality of papers 3 can be stacked on the multipurpose tray 14. A paper 3 is held between the roller 15 and the pad 15*a* by rotation of the roller 15 and a paper 3 is separated one by one and fed.

The image forming portion 5 is provided with a scanner unit 16, a process cartridge 17, a transfer roller 24 and a thermal fixing device 18.

The scanner unit 16 is arranged in an upper portion of the casing 2 and is provided with a laser emission portion (not shown), a rotatable polygon mirror 19, a lens 20, 21 and a reflection mirror 22. Laser beam emitted from the laser emission portion based on predetermined image data is passed or reflected via the polygon mirror 19, the lens 20, the reflection mirror 22 and the lens 21, as shown by a chain line. The laser beam is irradiated to a surface of a photosensitive drum 23 that is provided in the process cartridge 17.

The process cartridge 17 is arranged in a lower portion of the scanner unit 16 and is detachable from the casing 2. The process cartridge 17 has the photosensitive drum 23 and also has a scorotron-type charger (not shown), a developing roller and a toner storing member.

The positive charged non-magnetic one component polymerized toner is filled in the toner storing member. The developing roller bears toner in a thin layer of a certain thickness.

The photosensitive drum 23 is arranged rotatably facing the developing roller. A surface of the drum base is earthed and the positive charged photosensitive layer of polycarbonate is coated on the surface of the drum base.

The surface of the photosensitive drum 23 is positively charged uniformly by the scorotron-type charger according to the rotation of the photosensitive drum 23. Then, the surface of the photosensitive drum 23 is exposed by a laser beam from the scanner unit 16 and an electrostatic latent image is formed based on predetermined image data.

When the electrostatic latent image faces the developing roller, toner on the developing roller is supplied to the electrostatic latent image formed on the surface of the photosensitive drum 23 and only a portion of the photosensitive drum 23 corresponding to the electrostatic latent image bears toner.

The transfer roller 24 is arranged at a lower side of the photosensitive drum 23 and is supported rotatably by the casing 2 so as to face the photosensitive drum 23. The transfer roller 24 is obtained by covering the metal roller shaft with the conductive rubber material. A predetermined transfer bias is applied to the transfer roller 24.

Toner on the photosensitive drum 23 is transferred to the paper 3 when the paper 3 passes between the photosensitive drum 23 and the transfer roller 24. The paper 3 where toner is transferred is transported to the thermal fixing device 18 by a transporting belt 25.

The thermal fixing device 18 is arranged in the lower stream side of the process cartridge 17. The thermal fixing device 18 has a heat roller 26 and a pressure roller 27. The pressure roller 27 is arranged facing the heat roller having a paper 3 transporting path therebetween and presses the heat roller 26.

The heat roller 26 has a roller base body 32 made from a cylindrical aluminum and a first halogen lamp A and a second halogen lamp B.

Figure 2:
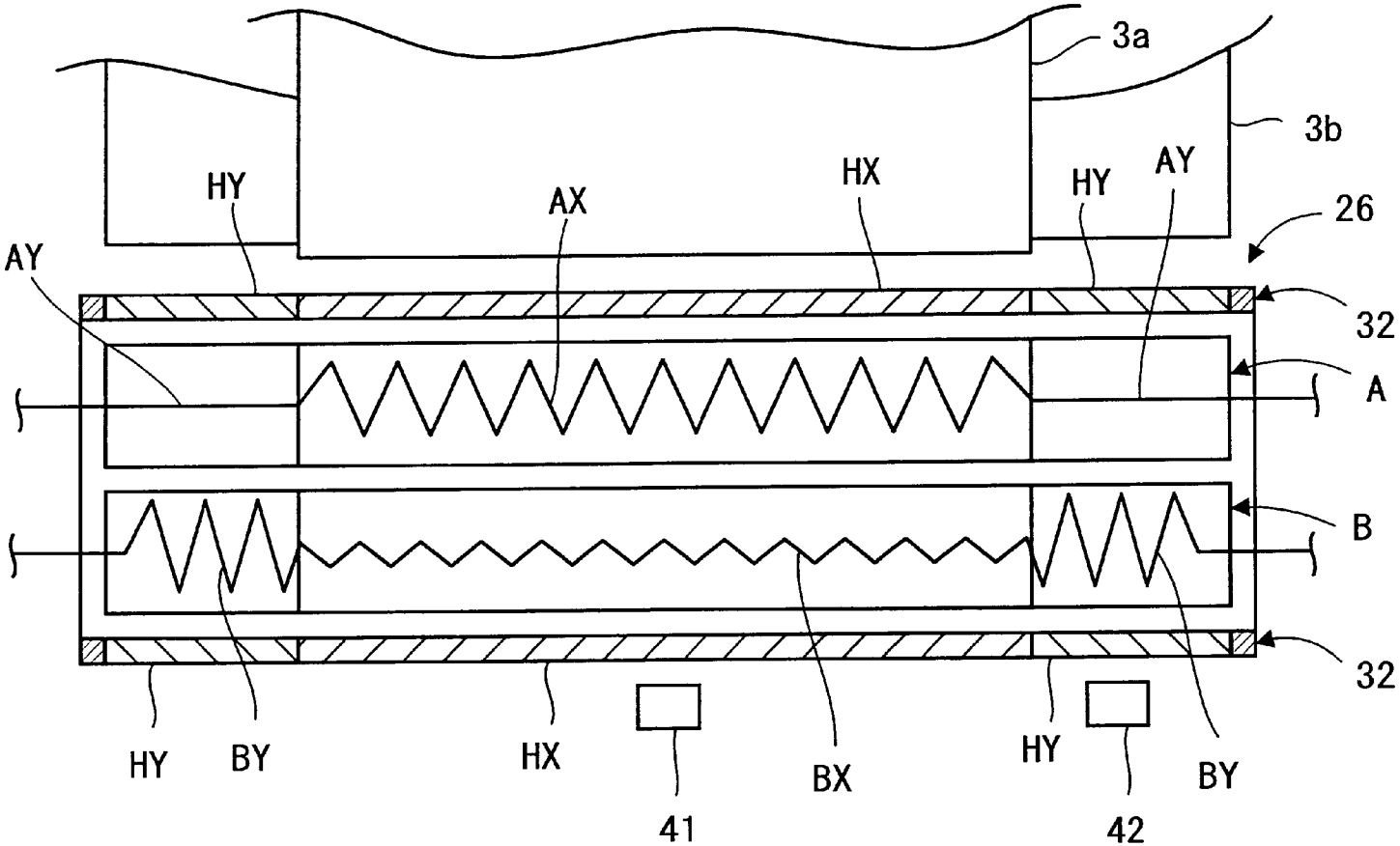
FIG. 2 is a longitudinal sectional view of main portions of a heat roller of the laser printer of FIG. 1.

The first halogen lamp A and the second halogen lamp B are arranged in the roller base body 32 parallel to the axial direction, as shown in FIG. 2. The roller base body 32 is heated by heat generated from the first halogen lamp A and the second halogen lamp B.

The pressure roller 27 is obtained by covering a metal roller axis with an elastic material and presses the heat roller 26 with a predetermined pressing force.

Toner transferred to the paper 3 in the process cartridge 17 is melted by heat and fixed to the paper 3 while the paper 3 passes through between the heat roller 26 and the press roller 27.

The paper 3 that toner is fixed on in the thermal fixing device 18 is transported to a transporting roller 28, a transporting roller 29 and a discharge roller 30 that are arranged on the down stream side from the transporting roller 28. The paper 3 is discharged to a tray 31 by the discharge roller 30.

In the laser printer 1 of this embodiment, printing can be performing on a paper 3 of various sizes ranging from a small size paper 3*a* to a large size paper 3*b*.

A fixing operation can be executed to a paper of various sizes ranging from a small size paper 3*a* to a large size paper 3*b* in the thermal fixing device 18.

Hereinafter, a structure and control for executing a fixing operation, with the same quality, for a small size paper 3*a* and a large size paper 3*b* will be explained.

In the explanation below, an A5 size paper (148 mm width) as the small size paper and an A4 size paper (209 mm width) as the large size paper will be used. However, it should be appreciated that any number of papers of any variable size can be used.

An outer diameter of the roller base body 32 of the heat roller 26 is 30 mm and an inner diameter thereof is 28 mm and a thickness thereof is 1 mm. Therefore, the heat capacity of the roller base body 32 is approximately 0.2 J/mm that is calculated based on the heat capacity of aluminum.

Speed (printing speed) for forming an image on a large size paper 3*b* by the laser printer 1 of this embodiment is 28 ppm (pages/min). In this case, the calorie required for the roller base body 32 is approximately 700W. The axial length of the roller base body 32 is almost same as the width of a large size paper 3*b*. Therefore, the thermal density M required for fixing is 700W/209 mm=3.35W/mm. The thermal density is a calorific value in a unit length and a unit time and an unit of the thermal density is W/mm.

The upper limit fixing temperature TH of the heat roller 26 is 180° C. and the lower limit fixing temperature TL is 175° C. A fixing temperature range Tm of the thermal fixing device 18 is from 175° C. to 180° C. The fixing temperature range Tm is set freely according to the characteristic of the toner.

The thermal fixing device 18 has a first temperature sensor 41 and a second temperature sensor 42 corresponding to a first region HX and a second region HY of the roller base body 32 respectively. The first region HX and the second region HY will be explained later.

Temperature of the first region HX and the second region HY of the roller base body 32 is detected correctly by the first temperature sensor 41 and the second temperature sensor 42 and the first halogen lamp A and the second halogen lamp B can be precisely controlled. Therefore, the temperature of the roller base body 32 can be maintained stably within the fixing temperature range Tm and the fixing operation can be executed with high quality.

As shown in FIG. 2, the first halogen lamp A has a first heat region AX and a second heat region AY. The first heat region AX corresponds to the first region HX of the roller base body 32 that a small size paper 3*a* contacts. The second heat region AY corresponds to the second region HY of the roller base body 32 that is continued from two axial ends of the first region HX and a small size paper 3*a* does not contact but a large size paper 3*b* contacts.

Figure 3A:
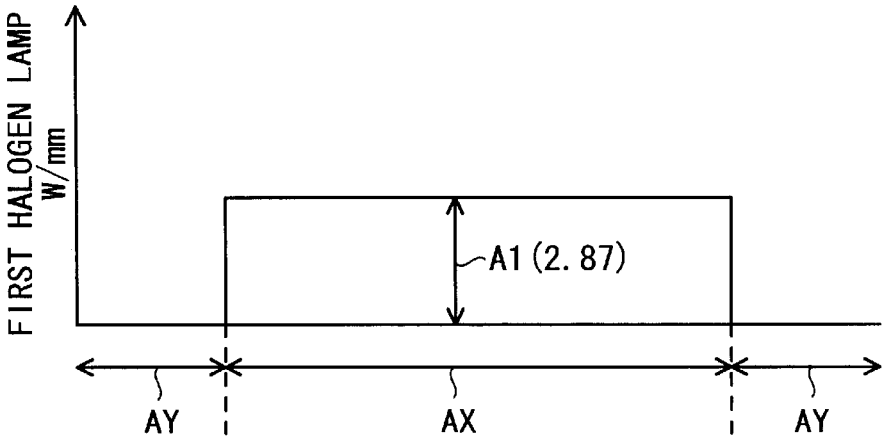
FIG. 3 is a schematic view of a heat region of a first halogen lamp and a second halogen lamp shown in FIG. 2.

As shown in FIG. 3A, the thermal density A1 of the first heat region AX is set higher than the thermal density A2 of the second heat region AY.

As shown in FIG. 2, the second halogen lamp B has a first heat region BX and a second heat region BY similar to the first halogen lamp A. The first heat region BX corresponds to the first region HX of the roller base body 32 that a small size paper 3*a* contacts. The second heat region BY corresponds to the second region HY of the roller base body 32 that is continued from two axial ends of the first region HX and a small size paper 3*a* does not contact but a large size paper 3*b* contacts.

Figure 3B:
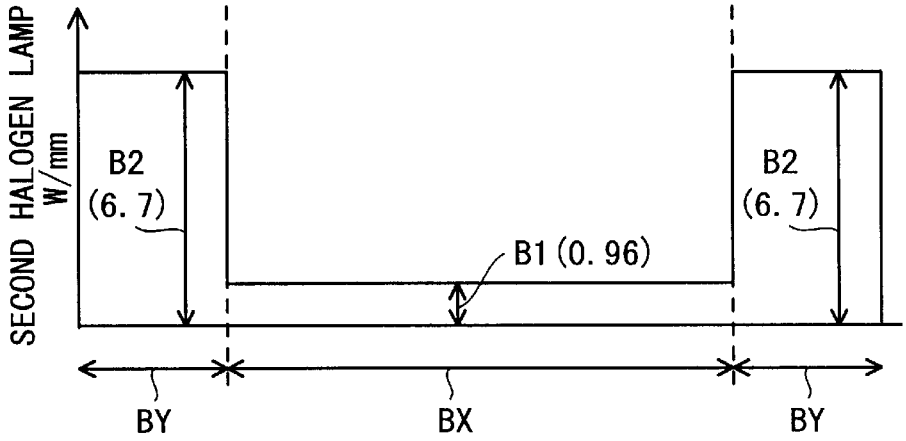

As shown in FIG. 3B, the thermal density B1 of the first heat region BX is set smaller than the thermal density B2 of the second heat region BY.

The thermal density A1, the thermal density A2, the thermal density B1 and the thermal density B2 are set so as to satisfy the following formula:

$$A1+B1<A2+B2 \quad (1)$$

As shown in FIG. 3A, in the first halogen lamp A, the thermal density A1 of the first heat region AX is set to 2.87 W/mm and the thermal density A2 of the second heat region BY is set to 0 W/mm. Strictly speaking, the thermal density A2 is not 0 W/mm because there is a little resistance. However, because a resistance is not applied actively, the thermal density A2 is set 0 W/mm in this embodiment.

As shown in FIG. 3B, in the second halogen lamp B, the thermal density B1 of the first heat region BX is set to 0.96 W/mm and the thermal density B2 of the second heat region BY is set to 6.7 W/mm.

The thermal density A1 is set higher than the thermal density A2 and the thermal density B1 is set smaller than the thermal density B2. When the fixing operation is executed to a small size paper 3*a*, only the first halogen lamp A is turned on and the second halogen lamp B is off. Therefore, only the first region HX that a small size paper 3*a* contacts is exactly heated by the heat region AX of the first halogen lamp A. The fixing operation is precisely executed to a small size paper 3*a*.

At this time, a small size paper 3*a* does not contact the second region HY of the roller base body 32. Because the thermal density A2 of the second heat region AY of the first halogen lamp A is smaller than the thermal density A1 of the first heat region AX and heat is not generated from the second halogen lamp B, the second region HY of the roller base body 32 is not heated excessively when the thermal fixing operation is executed to a small size paper 3*a*.

When the fixing operation is executed to a large size paper 3*b*, the first halogen lamp A is turned on and the second halogen lamp B is also turned on. The thermal density B2 of the second heat region BY of the second halogen lamp B is higher than the thermal density B1 of the first heat region BX and the thermal density A2 of the second heat region AY of the first halogen lamp A is smaller than the thermal density A1 of the first heat region AX. Therefore, the temperature of the first region HX of the roller base body 32 can be maintained less than or equal to the upper limit fixing temperature TH and the temperature of the second region HY can be increased to more than or equal to the lower limit fixing temperature TL.

Therefore, the temperature of the first region HX and the second region HY of the roller base body 32 that a large size paper 3*b* contacts can be maintained within the fixing temperature range Tm by the first halogen lamp A and the second halogen lamp B.

Even if the fixing operation of a large size paper 3*b* is executed right after the fixing operation of a small size paper 3*a*, hot offset in the second region HY can be effectively prevented.

In the thermal fixing device 18, the thermal density A1 of the first region AX of the first halogen lamp A and the thermal density A2 of the second heat region AY and the thermal density B1 of the first heat region BX of the second halogen lamp B and the thermal density B2 of the second heat region BY are set so as to satisfy formula (1).

That is, the thermal density of a whole second heat region for heating the second region HY of the roller base body 32 (A2+B2) is larger than the thermal density of a whole first heat region for heating the first region HX (A1+B1).

Figure 4A:
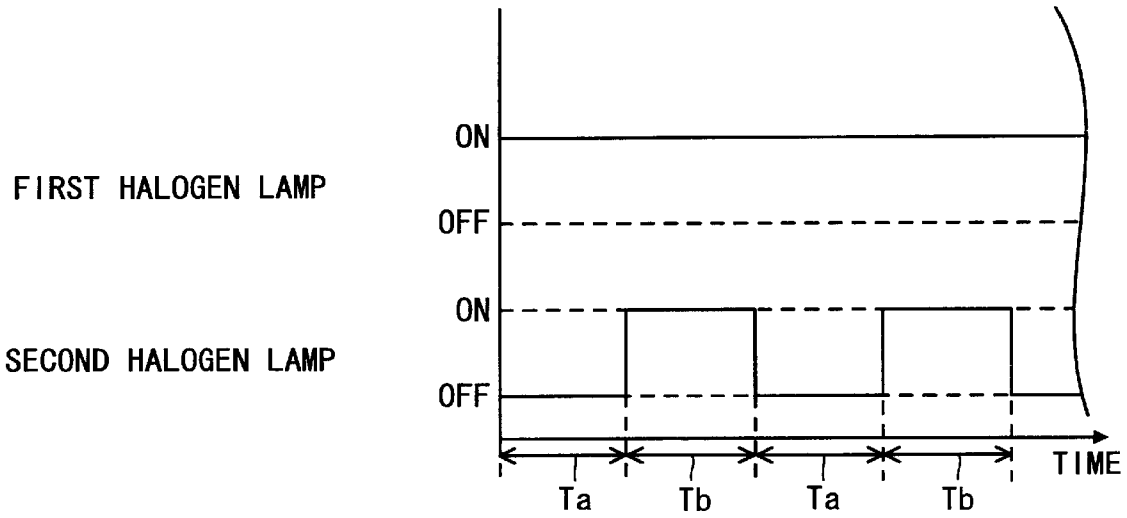
FIGS. 4A and 4B are on/off timing charts of the first halogen lamp and the second halogen lamp shown in FIG. 2.

In the fixing operation of a large size paper 3*b*, as shown in FIG. 4A, the first halogen lamp A is always on and the second halogen lamp B is controlled to be on/off repeatedly. When the second halogen lamp B is off (off time Ta), the first area HX of the roller base body 32 is intermittently heated by the first heat region AX of the first halogen lamp A that is always on. However, because the second region HY is not heated by either the first halogen lamp A or the second halogen lamp B, the temperature of the second region HY is decreased rapidly compared to the first region HX, as shown in FIG. 5A.

Figure 5A:
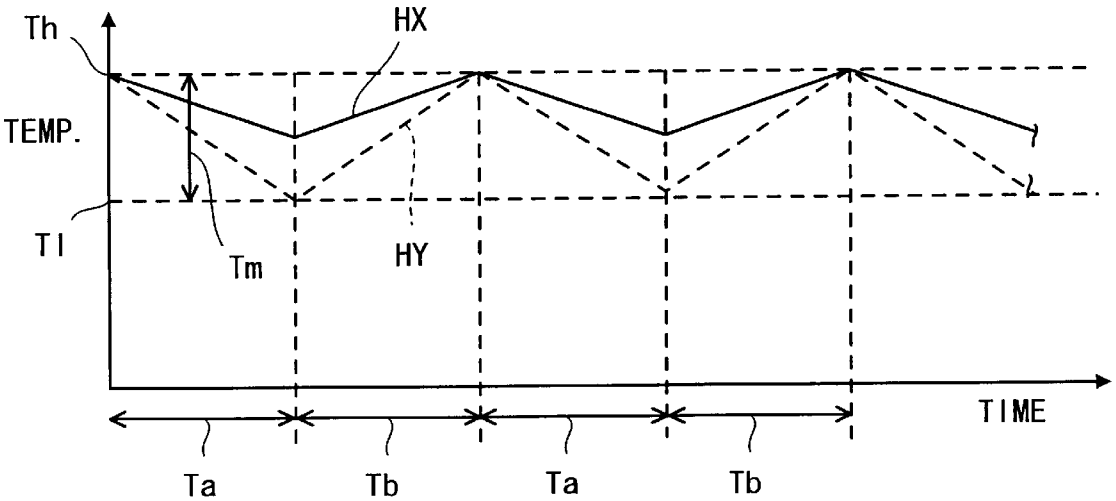
FIGS. 5A and 5B are charts showing temperature change in a first region and a second region in case of a thermal fixing operation of a large paper.

When the second halogen lamp B is turned on, as shown in FIG. 5A, the temperature of the second region HY is increased faster than the first region HX and therefore, the second region HY reaches the upper limit fixing temperature TH at a same timing as the first region HX or faster than the first region HX. The temperature of the whole roller base body 32 can be maintained stably within the fixing temperature range Tm. In FIG. 5A, the roller base body 32 is controlled so that the second area HY and the first area HX have same temperature at the upper limit fixing temperature TH.

Figure 5B:
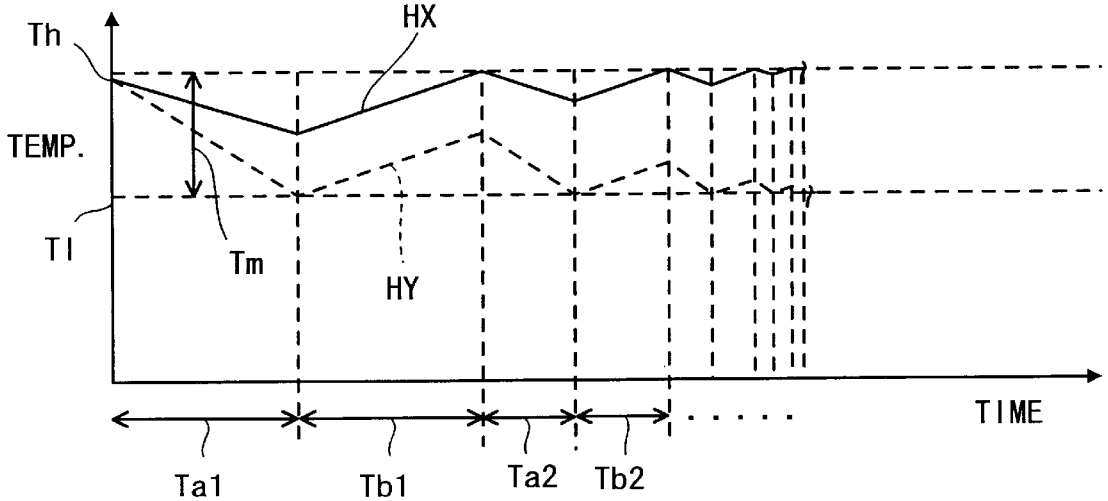

Conversely, assume that the thermal density of a whole second heat region (A2+B2) is equal to or smaller than the thermal density of a whole first heating area (A1+B1). As shown in FIG. 5B, when the second region HY reaches the lower limit fixing temperature TL and the second halogen lamp B is turned on, the temperature of the first region HX is increased at a same timing as the second region HY or faster than the second region HY. Therefore, the first region HX reaches the upper limit temperature TH earlier than the second region HY and the second halogen lamp B is turned off. The temperature of the second region HY starts to be decreased and the temperature of a whole roller base body 32 cannot be maintained stably within the fixing temperature range Tm.

In the thermal fixing device 18 of this embodiment, the temperature can always be maintained within the stable fixing temperature range Tm and the fixing operation can be executed for papers 3 of different sizes without causing a hot offset.

In the thermal fixing device 18, the thermal density A1 (2.87 W/mm) of the first heat region AX of the first halogen lamp A is set to be smaller than the thermal density M that is required for fixing (3.35 W/mm).

If the thermal density A1 of the first heat region AX of the first halogen lamp A is set to be larger than or equal to the thermal density M required for fixing, the first region HX of the roller base body 32 is heated excessively by the first heat region AX when the fixing operation is executed to a large size paper 3*b*. Therefore, it is necessary to control the first halogen lamp A to be on/off.

However, in this embodiment, the thermal density A1 (2.87 W/mm) of the first heat region AX of the first halogen lamp A is set smaller than the thermal density M required for fixing (3.35 W/mm). Therefore, when the thermal fixing operation is executed to a large size paper 3*b*, the first halogen lamp A is always on and the second halogen lamp B is controlled to be on/off. That is, because on/off control is executed only to the second halogen lamp B, the temperature of the roller base body 32 can easily be maintained within the thermal fixing temperature range Tm.

In the thermal fixing device 18 of this embodiment, the total thermal density A1 (2.87 W/mm) of the first heat region AX of the first halogen lamp A and the thermal density B1 (0.96 W/mm) of the first heat region BX of the second halogen lamp B (A1+B1=2.87+0.96=3.83 W/mm) is set to be larger than the thermal density M required for fixing (3.35 W/mm).

Therefore, when the second halogen lamp B is turned on in the fixing operation of a large size paper 3*b*, the temperature can be increased to the fixing temperature more rapidly.

In the thermal fixing device 18 of this embodiment, the thermal density A1, the thermal density B1 and the thermal density M are set so as to satisfy the relation of a following formula (2). In the fixing operation of a large size paper 3*b*, fixing can be executed rapidly and exactly by the first halogen lamp A and the second halogen lamp B.

$$A1<M<A1+B1 \tag{2}$$

Next, control for executing the fixing operation of a large size paper 3*b* with the thermal fixing device 18 will be explained. Control of the fixing temperature range Tm is executed by a heating control program stored in a ROM of a CPU (not shown).

In the fixing operation of a large size paper 3*b*, the first halogen lamp A is always on and the second halogen lamp B is controlled to be on/off by the heating control program, as shown in FIG. 4A. In FIG. 4A, the off time of the second halogen lamp B is represented by Ta and on time of the second halogen lamp B is represented by Tb.

A ratio occupied by the on time Tb of the second halogen lamp B with respect to one cycle of on/off of the second halogen lamp B is determined as follows.

The thermal density (M−A1) that is obtained by subtracting the thermal density A1 of the first heat region AX of the first halogen lamp A from the thermal density M required for fixing is divided by the thermal density B1 of the first heat region BX of the second halogen lamp A. The ratio is obtained by a following formula (3).

$$(M-A1)/B1 \tag{3}$$

In this embodiment, (M−A1)/B1=(3.35−2.87)/0.96=0.5. The second halogen lamp B is controlled so that the on time Tb occupies 50% and the off time Ta occupies 50% in one cycle.

Because the second halogen lamp B is controlled to be on/off according to the above formula (3), the calorific value required for the fixing operation of a large size paper 3*b* can be supplied enough to the roller base body 32 where only the first region HX is always heated by the first halogen lamp A.

A period of the off time Ta of the second halogen lamp B is a time that is required so that the temperature of the roller base body 32 is decreased from the upper limit fixing temperature TH to the lower limit fixing temperature TL when the second halogen lamp B becomes off. That is, a length of the off time Ta is within a time length required so that the temperature is decreased from 180° C. to 175° C. and a length of the on time Tb and the off time Ta is set so as not to cause a flicker.

The time required so that the temperature of the roller base body 32 is decreased from the upper limit fixing temperature TH to the lower limit fixing temperature TL when the second halogen lamp B becomes off is determined as follows.

The temperature decrease of the first region HX in the off time Ta is determined by [(the thermal density required for fixing—the total thermal density of the first heat region)/the heat capacity of the roller]. In this embodiment, it is determined that (M−(A1+B1))/0.2=(3.35−(2.87+0))/0.2=2.4° C./sec.

Temperature decrease of the second region HY is determined by [(the thermal density required for fixing—the total thermal density of the second heat region)/the heat capacity of the roller]. In this embodiment it is determined that (M−(A2+B2))/0.2=(3.35−(0+0))/0.2=16.75° C./sec.

During the off time Ta of the second halogen lamp B, the temperature is lowered by 2.4° C. every second in the first region HX and the temperature is decreased by 16.75° C. every second in the second region HY. (referring to FIG. 5A)

The time required so that the temperature is decreased from the upper limit fixing temperature TH (180° C.) to the lower limit fixing temperature TL (175° C.) in the second region HY of the roller base body 32 during the off time Ta of the second halogen lamp B is determined as follows: 5/16.75=0.3 seconds. Thus, the off time Ta of the second halogen lamp B becomes smaller than 0.3 seconds. (Ta<0.3 seconds). That is, to maintain the second region HY within the fixing temperature range Tm, the second halogen lamp B needs to be turned on within 0.3 seconds after the second halogen lamp B is turned off.

If the halogen lamp is turned on/off frequently, flicker is caused. Therefore, the length of the on time Tb and the off time Ta is set so as not to cause flicker. The time length that does not cause flicker is frequency of voltage fluctuation that satisfies predetermined conditions provided in European Standard (EN61000-3-3). The time length that does not cause flicker is a value that is precisely determined by the frequency of the on/off of an electric system or voltage or electricity of an apparatus. The time length that causes flicker is measured for each lamp by a flicker measuring device.

The thermal fixing device 18 of this embodiment is thus measured by the flicker measuring device. When it is determined that flicker is caused in the case when on/off is repeated more than or equal to three times in a second, the following condition needs to be satisfied so that flicker is not caused:

$$(Ta+Tb)(3-1)>1$$

Because Ta=Tb, Ta is larger than 0.25 seconds (0.25 seconds<Ta). In order to prevent a flicker, the length of the off time Ta of the second halogen lamp B needs to be more than or equal to 0.25 seconds.

The time length (seconds) of the on time Tb and the off time Ta of the second halogen lamp B that satisfies above-described two conditions is as follows:

$$0.25<Ta<0.3\ (Ta=Tb)$$

In the control of the thermal fixing device 18 shown in FIG. 4A, the on time Tb of the second halogen lamp B is equal to the off time Ta of the second halogen lamp B and each of the on time Tb and the off time Ta is set in a range of 0.25–0.3 seconds.

As shown in FIG. 5A, the first region HX is continuously heated by the first halogen lamp A that is always on during the off time Ta of the second halogen lamp B. However, the second region HY is not heated by either the first halogen lamp A or the second halogen lamp B. Therefore, the temperature of the second region HY is decreased faster compared to the first region HX and reaches the lower limit fixing temperature TL.

When the second temperature sensor detects that the lower limit fixing temperature TL is reached, the second halogen lamp B is turned on. The temperature of the second region is increased faster than that of the first region HX and the temperature of the second region HT and that of the first region HX reach the upper limit temperature TH at almost the same timing.

When the second temperature sensor detects that the upper limit fixing temperature TH is reached, the second halogen lamp B is turned off again.

The second halogen lamp B is turned on/off repeatedly and the temperature of the first region HX and the second region HY is maintained within the fixing temperature range Tm exactly and stably. The fixing operation of a large size paper 3*b* can be stably executed.

The second halogen lamp B is turned on again while the surface temperature of the roller base body 32 is decreased from the upper limit fixing temperature TH to the lower limit fixing temperature TL when the second halogen lamp B is off. Therefore, it can be exactly prevented that the temperature of the roller base body 32 is decreased below the lower limit fixing temperature TL.

Because the length of the on time Tb and the off time Ta is set for repeating the on/off of the halogen lamp so as not to cause flicker, voltage fluctuation that effects a circuit can be prevented and the flicker can be exactly prevented even when the halogen lamp is repeatedly turned on/off.

Next, control of the fixing operation of a small size paper 3*a* by the thermal fixing device 18 of this embodiment will be explained. Control of the fixing temperature range Tm is executed by a heating control program stored in the ROM of the CPU (not shown) provided in the laser printer 1.

Figure 4B:
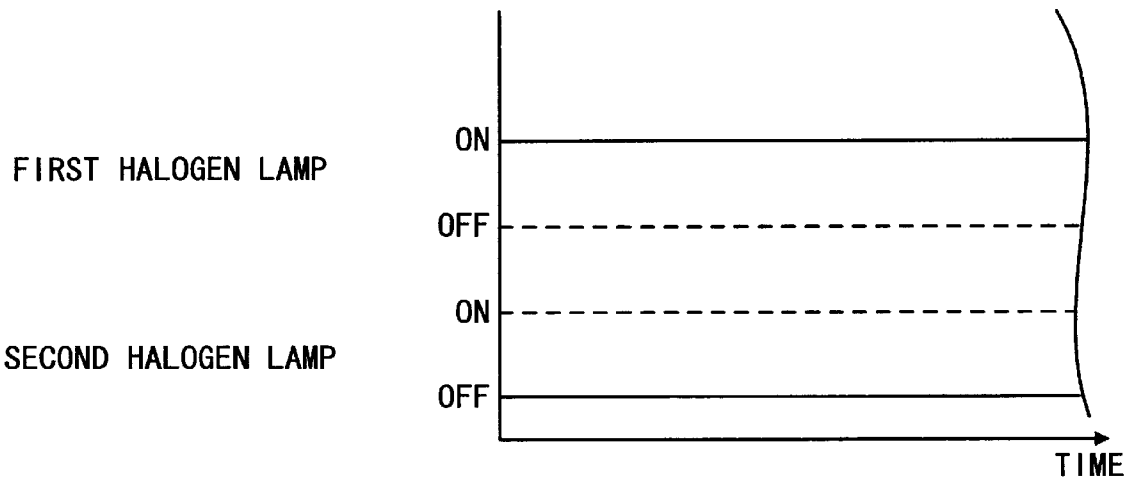

In the fixing operation of a small size paper 3*a*, as shown in FIG. 4B, the first halogen lamp A is controlled to be always on and the second halogen lamp B is controlled to be always off by the heating control program. The printing speed for printing a small size paper 3*a* is controlled to be slower than the printing speed for printing a large size paper 3*b*.

In the thermal fixing device 18 of this embodiment, the thermal density M required for fixing is 3.35 W/mm and the thermal density A1 of the first heat region AX of the first halogen lamp A is 2.87 W/mm. Therefore, even if the first halogen lamp A is always on, it is 3.35−2.87=0.48 W/mm short of the thermal density M required for fixing. That is, the surface temperature of the first region HX of the roller base body 32 is decreased gradually.

The shortage can be supplied by controlling the on/off of the second halogen lamp B. However, the length of the on time Tb and the off time Ta of the second halogen lamp B needs to be shorter than a case of the fixing operation of a large size paper 3*b* so that the surface temperature of the second region HY is not increased too high. Therefore, flicker may be caused.

In this embodiment, the printing speed for printing a small size paper 3*a* is controlled to be slower than the printing speed for printing a large size paper 3*b*. Therefore, the temperature of the roller base body 32 can be maintained within the fixing temperature range Tm. A precise fixing operation of a small size paper 3*a* can be executed by turning on only the first halogen lamp A.

The printing speed for printing a small size paper 3*a* is determined by [(the ratio of the thermal density A1 of the first heat region with respect to the thermal density M required for fixing)(the printing speed of a large size paper 3*b*)]. In this embodiment, it is determined that (A1/M)*28 [ppm]=(2.87/3.35)*28=24[ppm]. Printing of a small size paper 3*a* is controlled to be executed at a printing speed of 24 ppm by adjusting the rotation speed of the heat roller 26, the pressure roller 27, various rollers and the photosensitive drum 23.

Figure 6:
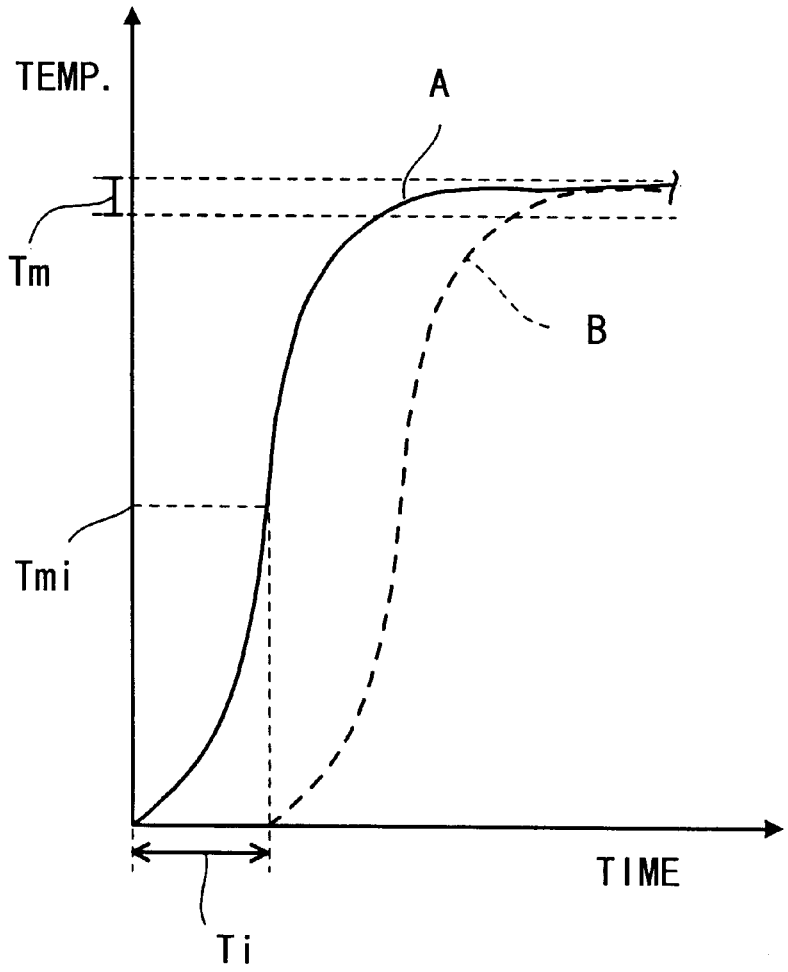
FIG. 6 is a chart showing temperature change of the first halogen lamp and the second halogen lamp when a printer is started.

In the thermal fixing device 18 of this embodiment, when the temperature of the roller base body 32 is increased to the fixing temperature range Tm after the printer is turned on or during the stand-by condition of the printer, the following control is executed according to a starting control program that is stored in the ROM of the CPU (not shown). As shown in FIG. 6, there is a time difference between the on timing of the first halogen lamp A and the on timing of the second halogen lamp B. The on timing of the second halogen lamp B is shifted by time Ti after the on timing of the first halogen lamp A.

After the printer is turned on or during the stand-by condition of the printer, the temperature of the first halogen lamp A or the second halogen lamp B is normally low and electric resistance is small. When the halogen lamp is turned on in this condition, a large rush of current is generated and flicker may be caused.

Recently, as the image forming speed has been increased, the thermal fixing speed is also increased and the thermal fixing device 18 of a large heat capacity is needed. However, flicker is not prevented in the thermal fixing device 18 of the large heat capacity.

In the thermal fixing device 18 of this embodiment, when the temperature of the halogen lamp is increased to the fixing temperature range Tm from a low temperature after the printer is turned on or during the stand-by condition of the printer, the first halogen lamp A and the second halogen lamp B are controlled as follows. After the first halogen lamp A is turned on and the time Ti for increasing the temperature of the first halogen lamp A to temperature Tmi has passed, the second halogen lamp B is turned on. At the temperature Tmi, the resistance of the first halogen lamp A becomes large enough. The rush of current caused to both halogen lamps A and B simultaneously is prevented and flicker can be exactly prevented. As a result, precise fixing can be achieved for papers 3 of different sizes.

As explained above, in the laser printer 1 of this embodiment, the temperature of the heat roller can be always maintained within the fixing temperature range Tm stably in the fixing operation of papers 3 of different sizes by operating the thermal fixing device 18 provided with the first halogen lamp A and the second halogen lamp B according to the heating control program. Therefore, a hot offset is not caused and the fixing operation can be executed rapidly. Images of fine quality can be formed.

In the embodiment as explained above, the first halogen lamp A has the first heat region AX and the second heat region AY and the second halogen lamp B has the first heat region BX and the second heat region BY. However, the invention is not limited to this embodiment. The number of halogen lamps may be more than or equal to three and each halogen lamp may have more than or equal to three heat regions.

A plurality of halogen lamps are comprised of a first halogen lamp A, a second halogen lamp B . . . a Nth halogen lamp N and each halogen lamp has a first heat region, a second heat region . . . a nth heat region. Suppose that the first heat region corresponds to an area of the roller base body 32 that a small size paper 3*a* contacts. In the supposition, the thermal density of each heat region is determined as follows.

The total (A1+B1 . . . +N1) of the thermal density of the first heat region of each halogen lamp (A, B . . . N) becomes smaller than the total (A2+B2 . . . +N2, A3+B3 . . . +N3 . . . An+Bn . . . +Nn) of the thermal density of each heat region (2, 3 . . . n) other than the first heat region of each halogen lamp (A, B . . . N). The thermal density of each region is determined so as to satisfy the following formulas:

$$A1+B1 \ldots +N1<A2+B2 \ldots +N2$$

$$A1+B1 \ldots +N1<A3+B3 \ldots +N3$$

$$\cdot$$

$$\cdot$$

$$A1+B1 \ldots +N1<An+Bn \ldots +Nn \quad (4)$$

In the fixing operation of a small size paper 3*a*, a certain halogen lamp or certain halogen lamps is/are turned on wherein the thermal density of the first heat region is high and the thermal density of other heat regions is low and other halogen lamp(s) is/are turned off wherein the thermal density of the first heat region is low and the thermal density of other heat regions is high. An area of the roller base body 32 that corresponds to the first heat region is heated. Therefore, the fixing operation of a small size paper 3*a* can be precisely executed.

At this time, in an area of the roller base body 32 that a small size paper 3*a* does not contact, the thermal density of certain halogen lamp(s) is lower than the thermal density of the first heat region. Because heat is not generated from halogen lamp(s) other than certain halogen lamp(s), the area of the roller base body 32 that a small size paper 3*a* does not contact is not heated excessively.

In the fixing operation of a large size paper 3*b*, not only are certain halogen lamp(s), but also other halogen lamp(s) is/are turned on. In other halogen lamp(s), the thermal density of the first heat region is lower than the thermal density of other regions. In certain halogen lamp(s), the thermal density of the first region is higher than the thermal density of other regions.

Therefore, the temperature of the regions of the roller base body 32 other than the first heat region is increased rapidly and reaches the temperature that the fixing operation is possible. The temperature of the roller base body 32 can reach the temperature that the fixing operation is possible rapidly by controlling properly the on/off of certain halogen lamp(s) and other halogen lamp(s).

When the fixing operation of a large size paper 3*b* is executed right after the fixing operation of a small size paper 3*a*, a hot offset can be surely prevented.

Moreover, as shown in the above formulas (4), the total thermal density of the first heat region of each halogen lamp (A1+B1 . . . +N1) is set smaller than the total thermal density of each heat region other than the first heat region of each halogen lamp (A2+B2 . . . +N2, A3+B3 . . . +N3 . . . An+Bn . . . +Nn).

If the halogen lamp(s) other than certain lamp(s) is/are turned off during the fixing operation of a large size paper 3*b*, a temperature decrease in an area of the roller base body 32 that does not correspond to the first heat region is larger than the temperature decrease in an area of the roller base body 32 that corresponds to the first heat region.

However, the thermal density of the heat region other than the first heat region is larger than the thermal density of the first heat region when the halogen lamp(s) other than certain halogen lamp(s) is/are on. Therefore, the temperature increase in an area of the roller base body 32 that does not correspond to the first heat region is faster than the temperature increase in an area that corresponds to the first heat region. The temperature of the area of the roller base body 32 that does not correspond to the first heat region rapidly reaches the predetermined fixing temperature range Tm.

The temperature is controlled to be stably maintained within the fixing temperature range Tm. The fixing operation can be always executed stably within a predetermined fixing temperature range Tm for papers 3 of different sizes. Bad influences due to hot offset can be prevented.

In thermal fixing operation of a large size paper 3*b*, out of a plurality of halogen lamps, certain halogen lamp(s) is/are always on and other halogen lamp(s) is/are controlled to be on/off. In the certain halogen lamp(s), the thermal density of the first heat region is higher than the thermal density of other heat regions. In the other halogen lamp(s), the thermal density of the first heat region is lower than the thermal density of the other heat regions. Thus, the surface temperature of the roller base body 32 in the fixing operation of a large size paper 3*b* can be easily maintained within a predetermined fixing temperature range Tm and the fixing operation can be precisely executed.

In the above-described embodiment, the roller base body is heated by the halogen lamp. The invention can be applied to a fixing device wherein a film is heated by a resistance heating element or a fixing device using an electromagnetic induction heating member.

While the invention has been described in detail and with reference to the specific embodiments thereof, it would be apparent to those skilled in the art that various changes, arrangements and modifications may be applied therein without departing from the spirit and scope of the invention.

What is claimed is:

1. A fixing device, comprising:

a heating element that contains a first region and a second region next to the first region, the heating element contacting a recording medium;

a first heat generating element that heats the heating element, the first heat generating element contains a first heat region corresponding to the first region and a second heat region corresponding to the second region, a first heat density A1 of the first heat region of the first heat generating element is higher than a second heat density A2 of the second heat region of the first heat generating element; and a second heat generating element that heats the heating element, the second heat generating element contains a first heat region corresponding to the first region and a second heat region corresponding to the second region, a first heat density B1 of the first heat region of the second heat generating element is lower than a second heat density B2 of the second heat region of the second heat generating element, wherein the heat densities of A1, A2, B1 and B2 satisfy a numerical formula of $$(A1+B1)<(A2+B2).$$

2. The fixing device according to claim 1, wherein the first region of the heating elements corresponds to a width of a smallest recording medium usable for the fixing device.

3. The fixing device according to claim 2, wherein, when the smallest recording medium is used, the first heat generating element is always at an ON term and the second heat generating element is always at an OFF term, wherein the smallest recording medium is fed slower than the recording medium larger than the smallest recording medium.

4. The fixing device according to claim 1, wherein the heat densities of A1 and B1 and a heat density M which is necessary for a fixing operation satisfy a numerical formula of $$A1<M<(A1+B1).$$

5. The fixing device according to claim 4, wherein, when the recording medium larger than the smallest recording medium is used, the first heat generating element is always at an ON term and the second heat generating element is at either the ON term or an OFF term so as to keep a temperature of the fixing device in a predetermined range.

6. The fixing device according to claim 5, wherein a ratio of the ON term of the second heat generating element is calculated by a numerical formula of $$(M-A1)/B1.$$

7. The fixing device according to claim 5, wherein a length of the OFF term of the second heat generating element is determined so the temperature does not become under the predetermined range when the second heat generating element is at the OFF term.

8. The fixing device according to claim 7, wherein the lengths of the OFF term and the ON term is determined so a flicker does not occur.

9. The fixing device according to claim 1, wherein the second heat generating element is turned ON at a predetermined timing after the first heat generating element is turned ON.

10. The fixing device according to claim 9, wherein the predetermined timing is when a sensor detects a predetermined temperature.

11. The fixing device according to claim 1, further comprising:

a first sensor that detects a first temperature at the first region; and a second sensor that detects a second temperature at the second region.

12. An image forming apparatus, comprising:

an image forming unit for forming an image onto the recording medium, the image forming unit including the fixing device of claim 1;

a supply path for supplying the recording medium to the image forming unit; and a discharge path for discharging the recording medium from the image forming unit.

13. A fixing device, comprising:

a heating element that contains a plurality of regions, the heating element contacting a recording medium; and a plurality of heat generating elements that heats the heating element, each of the plurality of heat generating elements containing a plurality of heat regions, wherein a total thermal density of a first heat region of each heat generating element, corresponding to a first region of the heating element, is smaller than a total thermal density of each heat region other than the first heat region of each heat generating element.

14. The fixing device according to claim 13, wherein the first region of the heating elements corresponds to a width of a smallest recording medium usable for the fixing device.

15. The fixing device according to claim 14, wherein the following numerical formula is satisfied $$A1<M<(A1+N1)$$

where:

A1 is a first heat density of the first heat region of a first heat generating element;

N1 is a first heat density of the first heat region of another heat generating element; and M is a heat density which is necessary for a fixing operation.

16. The fixing device according to claim 15, wherein, when a recording medium larger than the smallest recording medium is used, the first heat generating element corresponding to the width of the smallest recording medium is always at an ON term and the another heat generating element is at either the ON term or an OFF term so as to keep a temperature of the fixing device in a predetermined range.

17. The fixing device according to claim 16, wherein a ratio of the ON term of the another heat generating element is calculated by a numerical formula of $$(M-A1)/N1.$$

18. The fixing device according to claim 16, wherein a length of the OFF term of the another heat generating element is determined so the temperature does not become under the predetermined range when the another heat generating element is at the OFF term.

19. The fixing device according to claim 18, wherein the lengths of the OFF term and the ON term is determined so a flicker does not occur.

20. The fixing device according to claim 14, wherein, when the smallest recording medium is used, a first heat generating element is always at an ON term and another heat generating element is always at an OFF term, wherein the smallest recording medium is fed slower than a recording medium larger than the smallest recording medium.

21. The fixing device according to claim 13, wherein another heat generating element is turned ON at a predetermined timing after a first heat generating element is turned ON.

22. The fixing device according to claim 21, wherein the predetermined timing is when a sensor detects a predetermined temperature.

23. The fixing device according to claim 13, further comprising:

a sensor at each of the plurality of regions that detects a temperature of each of the plurality of regions.

24. An image forming apparatus, comprising:

an image forming unit for forming an image onto the recording medium, the image forming unit including the fixing device of claim 13, a supply path for supplying the recording medium to the image forming unit; and a discharge path for discharging the recording medium from the image forming unit.

* * * * *